United States Patent [19]

Milner

[11] 4,179,055

[45] Dec. 18, 1979

[54] DEVICE FOR SEPARATING SHEET BAGS

[75] Inventor: Burl D. Milner, Grand Prairie, Tex.

[73] Assignee: W. R. Grace & Co., Duncan, S.C.

[21] Appl. No.: 803,184

[22] Filed: Jun. 3, 1977

[51] Int. Cl.[2] ..... B26F 3/02

[52] U.S. Cl. ..... 225/80; 225/38; 225/85; 225/91; 225/106

[58] Field of Search ..... 225/106, 85–87, 225/52, 51, 90, 91, 38, 1, 2, 47, 48, 80, 77

[56] References Cited

U.S. PATENT DOCUMENTS

| | | | |
|---|---|---|---|
| 210,679 | 12/1878 | Douty | 225/82 X |
| 1,912,363 | 6/1933 | Dewaide | 225/106 |
| 3,098,594 | 7/1963 | Williamson | 225/48 |
| 3,266,689 | 8/1966 | Hruby | 225/87 X |
| 3,510,033 | 5/1970 | Schramm et al. | 225/91 X |
| 3,707,251 | 12/1972 | Dashnier et al. | 225/47 X |
| 3,771,700 | 11/1973 | Garr | 225/77 X |

FOREIGN PATENT DOCUMENTS

| | | | |
|---|---|---|---|
| 826513 | 1/1952 | Fed. Rep. of Germany | 225/106 |
| 129785 | 10/1950 | Sweden | 225/82 |

*Primary Examiner*—J. M. Meister

*Attorney, Agent, or Firm*—John J. Toney; William D. Lee, Jr.; John B. Hardaway

[57] ABSTRACT

A device for separating from a continuous strip having score lines defining individual sheets or bags wherein a plate and a pressure bar justapositioned to the plate and spaced apart therefrom to permit the strip to pass therebetween is provided. A bearing or prong projects outwardly from the center portion of the plate in order to facilitate separation sections of the strip along the score lines and display the next succeeding section for easy grasp by an operator.

5 Claims, 5 Drawing Figures

DEVICE FOR SEPARATING SHEET BAGS

BACKGROUND OF THE INVENTION

This invention relates to a device for separating sheets from a supply roll of a continuous strip of material and more particularly to a device for separating bags from a roll of serrated bags.

In the packaging field, it is necessary and convenient to provide wrapping material in the form of a flexible sheet or bag in different width sheets or bags in a very limited amount of floor space. It is often necessary to supply the material in roll form whereby several rolls of varied size wrapping material can be made readily available in a limited amount of space near a packaging machine. Further, it is highly desirable to provide a means for an operator to easily and rapidly select and withdraw the right size of wrapping material for the article to be packaged.

While the present invention will be described in connection with particular embodiments relating to a dispenser-separator combination for dispensing plastic film such as plastic film bags for the rapid packaging of articles, it should be understood that the combination of the present invention is not necessarily limited thereto.

The packaging of products in sheets or bags made from plastic film presents a number of dispensing problems which burden overall packaging operation in a number of ways. In a typical operation, bags of like size are shipped flat or folded in half in quantities of as much as 500 to 1,000 or more. In one prior-art technique, like size bags are exposed in flat piles and tucked into a series of "pigeon hole" type recepticles from which the bags are selectively withdrawn as required. In another prior-art technique, bags of like size are folded over at mid-length and hung from a series of horizontally supported rods which are cantilevered radially from a rotable hub, like spokes on a horizontal disposed wheel. The spokes are rotated toward the bagging station in "Lazy Susan" fashion for selection of the appropriate size bags.

The bags, however, are large, limp and slippery. Unloading them from cartons and carefully loading stacks of them on such dispensers is time consuming and costly and often leaves them in disarray, requiring careful rearrangement. Once loaded, the subsequent removal of single bags from the stack often drags along additional undesired bags. The removal of single bags may also skew the remaining bags or completely dislodge them, causing them to slide to the floor. This slows the operation, raises cost, fatigues the operator, results in an untidy work station, creates contamination problems, particularly if food products are being packaged.

Another technique is in the form of rolled film material for dispensing one by one, e.g., rolled film or bags for home use is an everyday household commodity. These supply rolls are sold and used in individual containers which will have a tearing or cutting strip along one edge of the container for separating the material from the roll.

Another technique is wrapping material in roll form; such dispensers for multiple rolled film and bags are not new in the art. The same problems concerning dispensing individual bags from stacked bags also prevail when dispensing individual pieces of packaging material from roll stock, particularly when it comes to removal of the packaging material one piece at a time. U.S. Pat. No. 3,741,403 to Fleischer et al. discloses a rolled film dispenser of three units and each unit includes a storage roll trough and a dispensing trough. Each of the dispensing units has a wall portion having edges which converge upwardly to form a tearing edge. The same idea is also disclosed in U.S. Pat. No. 3,045,883 to Andrews et al. However, when a piece of material is removed from the supply roll in either of these dispensers, the leading portion of the remaining material is not held in a ready to use position for an operator.

Further, the multiple sheet dispensing apparatus in U.S. Pat. No. 3,691,727 to Doerschein, comprises means for supporting supply rolls of flexible sheets and a dispenser having a pair of pivotal plates for supporting each of the sheets mounted on and extending between the plates and a check means supported by the plates and arranged to bear against each of the sheets on the respective support means, the check means is movable away from the support means by the sheet when said sheet is pulled in a direction of withdrawal, but otherwise holding the sheet.

U.S. Pat. No. 3,702,672 to Becht shows a dispenser for rolled plastic bags having transverse tear lines comprising a carriage with side by side roll support means and a material support member and forward on the carriage and opposite the roll support means is an upstanding fixed support panel with an elongate upper marginal portional curved rearwardly towards the supply roll and downwardly to provide a horizontal, arcuate head over which may be trained plastic material of the support rolls. The panel includes a forward projection adapted to direct the leading ends of the roll materials forwardly in spaced relation to the panel. There is a U-shaped elongate friction bar coextensive in length with the head disposed in space relation thereto so as to form therewith a vertical throat through which the rolled material depends while supported upon the head. The separator of this dispenser is not only complicated by its many parts but would be awkward and time consuming to maintain the material in an easy ready to use position; e.g., the requirement of threading the material through the vertical throat and keeping the material threaded therethrough.

Other patents of interest are U.S. Pat. Nos. 3,837,549 and 3,987,603.

SUMMARY OF THE INVENTION

This invention provides a device for separating sheets or bags from a continuous strip of material comprising a plate with supporting material to be separated and a pressure or clamping bar juxtapositioned to the plate and spaced apart to permit the material therebetween, a bearing or prong projecting from the plate over which the material on the plate passes. The bearing forces a tear or separation transversely along the material when the material is pulled in a direction of withdrawal against the bearing. The leading edge of the remaining strip of material remains clamped between the support plate and pressure bar for easy grasping and withdrawing by an operator.

A further feature of this invention is an apparatus separating material from a supply roll, the material being a continuous strip having transverse scored lines for facilitating the separation from the other material from the supply roll comprising a frame, supply roll supporting members on the frame, and a separating device of this invention for each supply rolls.

BRIEF DESCRIPTION OF THE DRAWINGS

In the drawings which are appended hereto and made a part of this disclosure.

DETAILED DESCRIPTION

Figure 1:
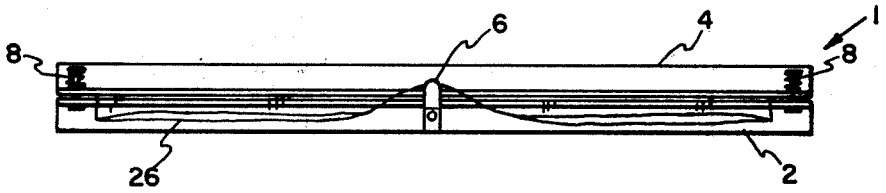
FIG. 1 is a front elevation view of a separating device in accordance with the invention.

In accordance with this invention it has been found that a clamping jaw device as shown in the drawings in not only an uncomplicated, space saving device but is an effective and time saving device for separating wrapping materials. These characteristics are very desirable and necessary in a rapid packaging operation.

Figure 2:
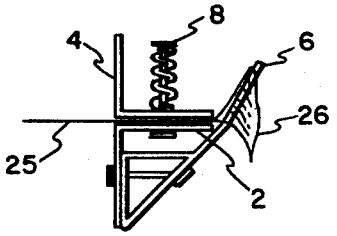
FIG. 2 is a left side elevation view of the separating device of FIG. 1.

Referring to FIGS. 1 and 2, the separating device 1 comprises a fixed support plate 2 for supporting the packaging material 25 to be separated and a reciprocably movable clamping or pressure bar 4 is spaced above and apart from the support plate 2 attached to the plate by a means 8 which will force the bar against the support plate but will also permit the bar to be raised under tension; such as, a compression spring. A means 8 permits a free flow or passage of material as well as permits the material 25 placed between the plate and bar to be clamped therebetween in a ready to use position; i.e., in a position for an operator to grasp and pull the forwardmost end 26 of the packaging material 25 forward. Attached to fixed plate 2 and projected toward the material being withdrawn is a tongue-shaped bearing or prong 6 with a smooth cutting edge that forces a tear or separation transversely along material 25 when the material is pulled in a direction of withdrawal against said bearing. It has been found that a bearing constructed from either flat or rod shaped material works well.

Figure 3:
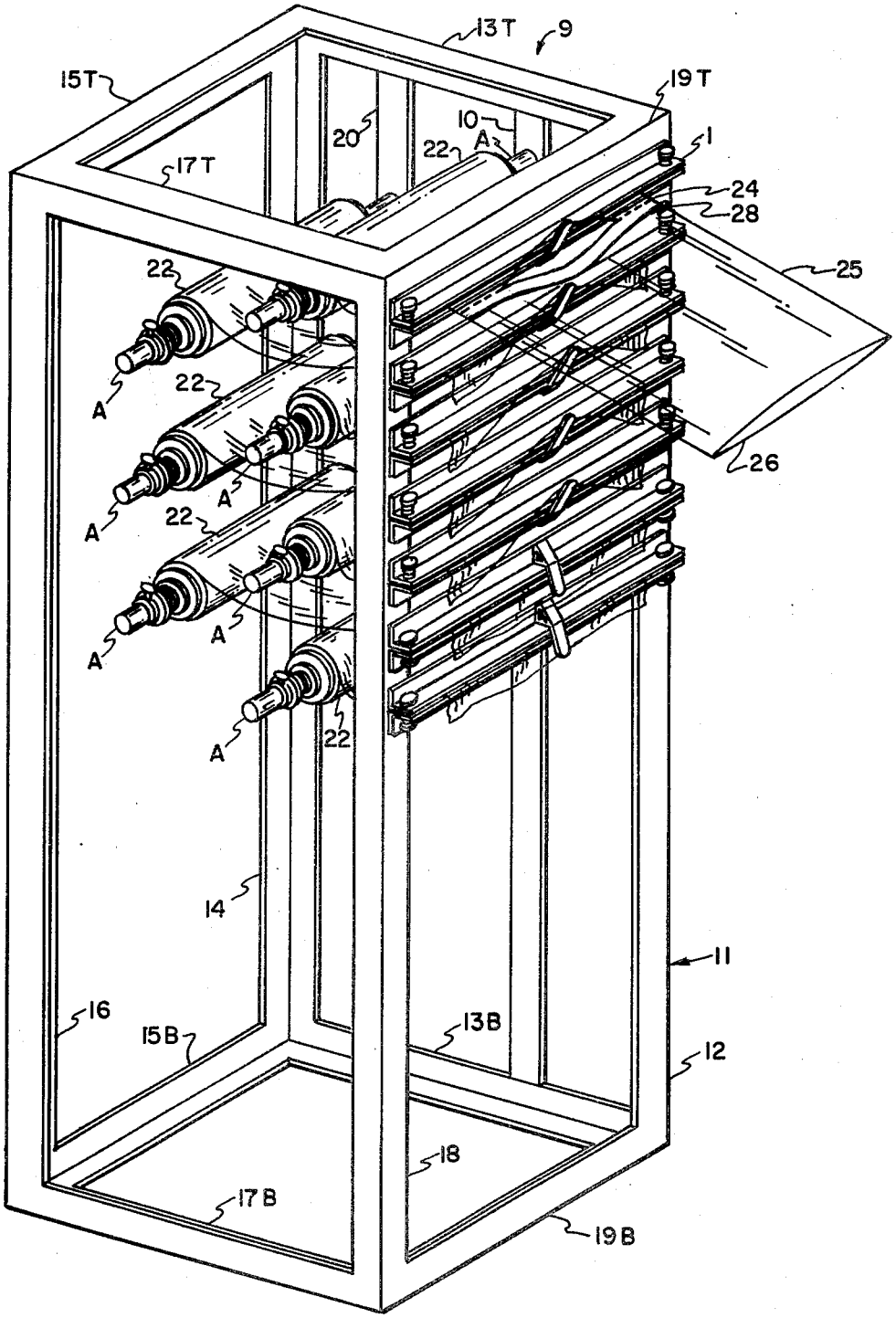
FIG. 3 is a perspective view of a dispenser illustrating the use of the device for separating material from a supply roll.
Figure 4:
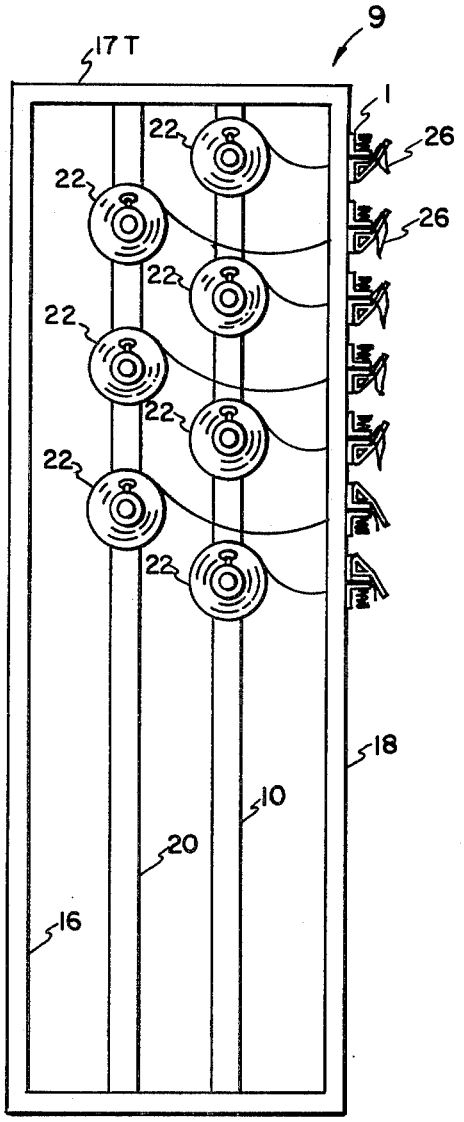
FIG. 4 is a left side elevation view of the dispenser of FIG. 3.

FIGS. 2 and 3 show the separating device 1 in combination with a material dispenser 9. For illustration purposes, apparatus 9 is shown as a standing or floor model but it is to be understood that apparatus 9 may easily be suspended from the ceiling. The apparatus 9 for dispensing of material 25 may comprise a box-like frame 11 which includes corner posts 12, 14, 16 and 18 with horizontal connecting struts indicated at 13B, 13T, 15B, 15T, 17B, 17T, 19B and 19T. Two parallel and spaced apart vertical members or shafts 10 and 20 attached to struts 13T and 13B having cantilevered therefrom rods A in a vertically staggered arrangement to provide space for supporting several supply rolls 22 of packaging material in a dispensing apparatus. Illustrated in FIG. 3, a supply roll 22 is a continuous strip of plastic packaging material 25 in the form of bags which are connected to each other in top 26 to bottom 28 relationship by perforated or scored lines 24 shows the leading bag pulled forward where perforated or scored line 24 is over bearing 6. The leading bag 25 on supply roll 22 is shown partially separated along scored line 24 from the continuous strip of bags; the separation having been forced by bearing 6 during withdrawal of bag 25 downwardly against said bearing. In some instances, depending upon the height of the supply rolls, it is easier, faster and more effective for an operator to withdraw the packaging material or bag in an upward motion and this can be accomplished simply by inverting separating device 1 whereby scored line 24 is still being forced against bearing 6. This is illustrated with the two bottom separating devices in FIG. 3.

A supply roll 22 comprises a continuous strip of packaging material or bags 25 wound onto a core (not shown) having first core plug 27 and second core plug 29 (FIG. 5) inserted into the opposite ends of the core; the core plugs rotate on the rod which rotates the supply roll. As shown, supply roll 22 is supported on one of the rods A with the leading end of the material or bag pulled forward through the respective separating device 1 and over bearing 6. It is most desirable to have the supply roll of packaging material positioned on the rod to permit the bearing to be positioned on center of the width of said material.

Figure 5:
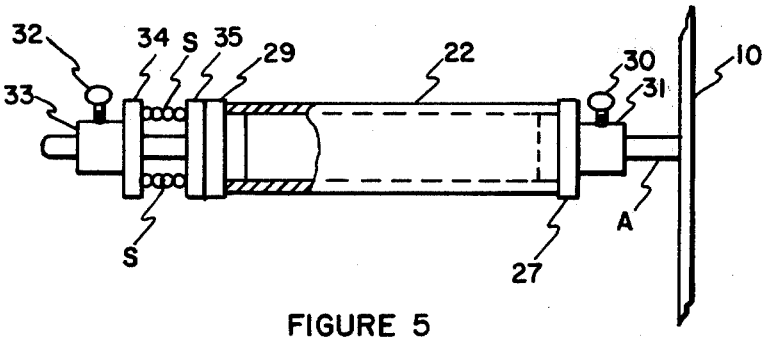
FIG. 5 is a front elevation view illustrating a braking means for a supply roll of material.

Braking of the supply roll will prevent free wheel unwinding of the continuous strip of packaging material during withdrawal which can be accomplished by many of the well known mechanisms for applying friction on a roll of material. However, the braking system described hereinafter permits better control on the amount of friction or restraint placed on the supply roll. Illustrated in FIG. 5 is a braking mechanism which has been found to perform very effectively. As shown, supply roll 22 has been slipped onto rod A over the open end thereof toward frame member 10 and has been locked into position away from shaft 10 by means of a first locking means or screw 30 which sets a first ring or collar 31 into a locked position against first core plug 27. At the open end of rod A, a second locking means or screw 32 sets a second ring or collar 33 into a locked position against a first friction plate 34 which is held apart from a second friction plate 35 by springs S, said second friction plate abuts second core plug 29. It is to be understood that a single friction plate of any type material that will restrain the core plug can be used; e.g., hard rubber, leather, etc., but as stated heretofore, the braking mechanism as described provides better control of the rotation of the core plugs; thusly, better control of the movement of the supply roll.

A dispensing apparatus of this type can easily be arranged to supply packaging materials of different sizes to two packaging operations by suspending an open frame from the ceiling between the two packaging operations and having the supply roll rods cantilevered in opposite directions from a center vertical frame member. The separation devices for the two vertical rows of rods can be placed on opposite sides of the frame; thusly, furnish packaging material, two packaging operations, one on each side of the apparatus.

The operation of separating device 1 will be explained in conjunction with dispenser 9 using packaging material in the form of scored bags. After a supply roll 22 of a continuous strip of bags 25 is slipped onto one of the rods A and locked into position as described heretofore, the forward most end of the lead bag is drawn forward through pressure bar 4 and support plate 2 and over bearing 6 of the rod's respective or corresponding device 1 until scored line 24 is against bearing 6 at which time the withdrawal of the bag is in a direction against the bearing which forces a separation along scored line 24. When the lead bag is withdrawn from the strip, a braking mechanism on the supply roll and a tensioning means on the pressure bar not only restrains the forward motion or pull of the packaging material but locks the supply roll and clamps the succeeding bag in the separating device, respectively, leaving a portion of the succeeding bag extended forward of the separating device for grasping by an operator for the next operation.

It is to be understood that the foregoing detailed description is given merely by way of illustration and that numerous modifications may be made therein without parting from the spirit or scope of this invention.

What is claimed is:

1. A device for separating sheets from a continuous strip of material comprising:

a horizontal plate for supporting said material to be separated;

a horizontal pressure bar juxtapositioned to said plate and spaced apart to define a horizontal slot therebetween to permit passage of said material therebetween;

means for urging said pressure bar into contact with said material to restrain the passage of material; and a bearing having a cutting edge projecting outwardly from the central portion only of said plate toward said pressure bar, said bearing vertically traversing the full height of said slot and terminating at a point offset from said pressure bar whereby said material must contact said pressure bar during passage through said slot and across said bearing and whereby said bearing facilitates separation of sheet sections along scores therebetween and display of the next succeeding sheet for easy grasp by an operator.

2. The device of claim 1 wherein said means for urging comprises a spring.

3. An apparatus for separating material from a supply roll, said material comprising a continuous strip having transverse scored lines for facilitating the separation of the material from the supply roll comprising:

a frame;

means on said frame for supporting said supply roll;

means for restraining the rotation of said roll;

means attached to said frame for separating sheets from said roll comprising, a horizontal plate, a horizontal pressure bar juxtapositioned to the plate and spaced apart to define a horizontal slot therebetween for the passage of said material therethrough said pressure bar including means for resiliently urging the slot defining thereof toward said plate, said pressure bar and said means for restraining opposing the movement of said material through said slot, a bearing having a cutting edge projecting outwardly from the central portion only of said plate toward said pressure bar, said bearing vertically traversing the full height of said slot and terminating at a point offset from said pressure bar, whereby said material must contact said pressure bar during passage through said slot and across said bearing and whereby said bearing facilitates separation of said material along said scored lines and display of the next succeeding strip from said supply roll.

4. The apparatus of claim 3 wherein said means for supporting said supply roll is a rod projecting from said frame.

5. An apparatus for manually dispensing bags from a supply roll of bags connected to each other in top to bottom relationship and scored at their junction for facilitating the separation of bags from said roll, said apparatus comprising in combination:

a frame;

a rod on said frame for rotatably supporting said supply roll;

means on said rod for placing tension on the supply roll during advancement of the bags to resist the rotation thereof during the pulling and movement of the leading bag;

a horizontal plate for supporting the leading end of a bag;

a horizontal pressure bar juxtapositioned to said plate to define a slot therebetween for the passage of said bags therethrough;

means for urging said pressure bar toward said plate; and a bearing having a cutting edge projecting outwardly from the central portion only of said plate toward said pressure bar, said bearing vertically traversing the full height of said slot and terminating at a point displaced from said pressure bar, whereby said bags must contact said pressure bar during passage through said slot and across said bearing, said pressure bar and said means for placing tension opposing the movement of said bags to facilitate the severance thereof along the scored junction when said junctions contact said cutting edge and whereby said bearing facilitates display of the next succeeding bag for easy grasp by an operator.

* * * * *